US008857516B2

(12) United States Patent
Ganguly et al.

(10) Patent No.: US 8,857,516 B2
(45) Date of Patent: Oct. 14, 2014

(54) METHODS FOR COMPLETING MULTI-ZONE PRODUCTION WELLS USING SLIDING SLEEVE VALVE ASSEMBLY

(75) Inventors: Partha Ganguly, Sugar Land, TX (US); Michael Huh, Alvin, TX (US); Jake Danos, Houston, TX (US); Bryan Stamm, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 530 days.

(21) Appl. No.: 13/221,588

(22) Filed: Aug. 30, 2011

(65) Prior Publication Data

US 2012/0048559 A1 Mar. 1, 2012

Related U.S. Application Data

(60) Provisional application No. 61/378,736, filed on Aug. 31, 2010.

(51) Int. Cl.
*E21B 43/26* (2006.01)
*E21B 43/14* (2006.01)

(52) U.S. Cl.
CPC ..... *E21B 43/26* (2013.01); *E21B 43/14* (2013.01)
USPC ..... 166/308.1; 166/177.5; 166/194; 166/332.1

(58) Field of Classification Search
CPC ..... E21B 43/26; E21B 43/14; E21B 43/16; E21B 43/267; E21B 34/14; C09K 8/62
USPC ..... 166/308.1, 177.5, 194, 332.1
See application file for complete search history.

(56) References Cited

U.S. PATENT DOCUMENTS

| | | | |
|---|---|---|---|
| 5,513,703 | A | 5/1996 | Mills et al. |
| 6,186,236 | B1 | 2/2001 | Cox |
| 7,387,165 | B2 | 6/2008 | Lopez de Cardenas et al. |
| 7,575,062 | B2 | 8/2009 | East |
| 2006/0124310 | A1 * | 6/2006 | Lopez de Cardenas et al. ..... 166/313 |
| 2009/0084553 | A1 * | 4/2009 | Rytlewski et al. ..... 166/305.1 |
| 2009/0260835 | A1 | 10/2009 | Malone |
| 2010/0012318 | A1 | 1/2010 | Luce |
| 2011/0056692 | A1 | 3/2011 | Lopez de Cardenas et al. |

OTHER PUBLICATIONS

International Search Report and Written Opinion of PCT Application Serial No. PCT/US2011/049764 dated Mar. 23, 2012.

* cited by examiner

*Primary Examiner* — Yong-Suk (Philip) Ro
(74) *Attorney, Agent, or Firm* — Patrick A. Traister; Brandon S. Clark

(57) ABSTRACT

Systems and methods for fracturing multiple zones in a wellbore. A first port in a first valve assembly can be opened with a shifting tool. A fluid flows through the first port to fracture a first zone, and the first port can be closed with the shifting tool after the first zone has been fractured. A second port can be opened in a second valve assembly with the shifting tool after the first port has been closed, wherein the second valve assembly is positioned below the first valve assembly. The fluid can flow through the second port to fracture a second zone, and the second port can be closed with the shifting tool after the second zone has been fractured.

20 Claims, 4 Drawing Sheets

METHODS FOR COMPLETING MULTI-ZONE PRODUCTION WELLS USING SLIDING SLEEVE VALVE ASSEMBLY

CROSS-REFERENCE TO RELATED APPLICATIONS

This application claims the benefit of and priority to U.S. provisional patent application having Ser. No. 61/378,736 that was filed on Aug. 31, 2010, the entirety of which is incorporated by reference herein.

BACKGROUND

Wellbores are drilled through subsurface formations to extract useful fluids, such as hydrocarbons. Once drilled, a liner or casing with built in valves can be run-in-hole (RIH) and cemented in place. Hydraulic fracturing can then take place to create a path of fluid communication from a zone in the subsurface formation through the valves and into the casing.

Oftentimes, a single wellbore will have multiple zones to be fractured. One conventional method for fracturing multiple zones involves a bottom-up approach where a lowermost zone is fractured first, and zones closer to the surface are subsequently fractured. To accomplish this, a shifting tool is lowered to a point proximate the valves in the lowermost zone. The shifting tool is adapted to engage and open the valves with an upward motion. Once opened, fracturing can take place in the lowermost zone. The shifting tool can then re-engage and close the valves with a downward motion.

When the shifting tool is lifted above the lowermost zone to begin the fracturing process in a higher zone, the upward motion of the shifting tool tends to engage and re-open the valves in the lowermost zone. This is undesirable, however, as only the valves in the zone to be fractured should be in the open position during the fracturing process. What is needed, therefore, is an improved system and method for fracturing multiple zones in a wellbore.

SUMMARY

Systems and methods for fracturing multiple zones in a wellbore are provided. In one aspect, the method is performed by opening a first port in a first valve assembly with a shifting tool, flowing a fluid through the first port to fracture a first zone, and closing the first port with the shifting tool after the first zone has been fractured. A second port can be opened in a second valve assembly with the shifting tool after the first port has been closed, wherein the second valve assembly is positioned below the first valve assembly. The fluid can flow through the second port to fracture a second zone, and the second port can be closed with the shifting tool after the second zone has been fractured.

In one aspect, the system includes a first valve assembly comprising a first sliding sleeve movable between open and closed positions; a first position indicator positioned below the first valve assembly; a second valve assembly positioned below the first position indicator and including a second sliding sleeve movable between open and closed positions; a second position indicator positioned below the second valve assembly; and a shifting tool. The shifting tool is adapted to move the first sliding sleeve to the open position to allow fracturing to occur in a first zone and then move the first sliding sleeve to the closed position, and subsequently move the second sliding sleeve to the open position to allow fracturing to occur in a second zone and then move the second sliding sleeve to the closed position.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings illustrate only typical embodiments and are therefore not to be considered limiting of its scope, for the invention can admit to other equally effective embodiments.

DETAILED DESCRIPTION

Figure 1:
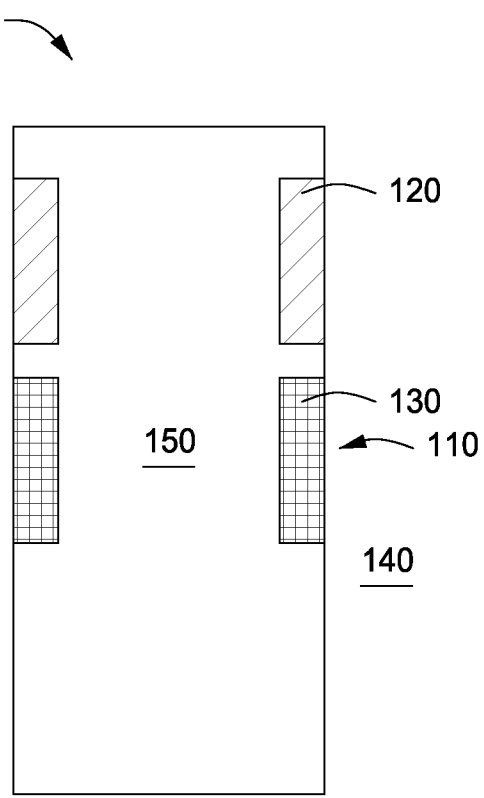
FIG. 1 depicts a cross-sectional view of an illustrative sliding sleeve valve assembly in an open position, according to one or more embodiments described.
Figure 2:
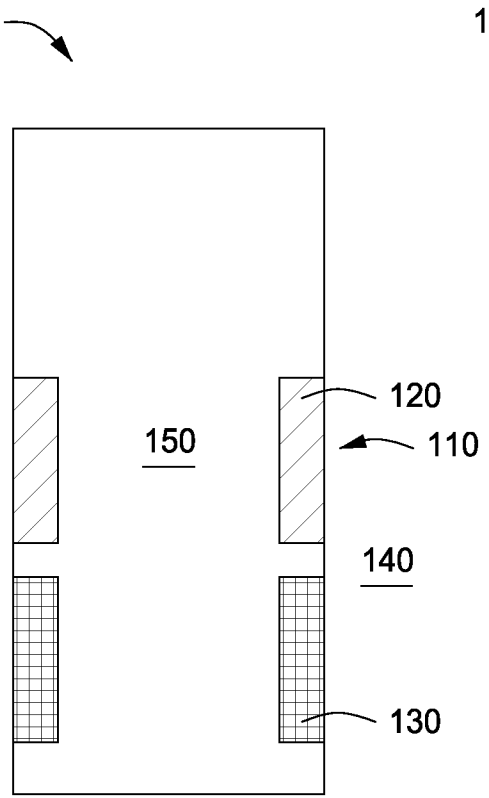
FIG. 2 depicts the sliding sleeve valve assembly of FIG. 1 in a closed position, according to one or more embodiments described.

FIG. 1 depicts a cross-sectional view of an illustrative sliding sleeve valve assembly 100 in an open position, and FIG. 2 depicts the sliding sleeve valve assembly 100 in a closed position, according to one or more embodiments. The valve assembly 100 can be coupled to or integral with a casing/liner that is disposed in a wellbore. The valve assembly 100 can include one or more radial ports 110 disposed about a circumference thereof. A sliding sleeve 120 can be coupled to the valve assembly 100 and adapted to slide between the open position (FIG. 1) and the closed position (FIG. 2).

When the valve assembly 100 is in the open position, the sliding sleeve 120 is axially-offset from, and does not obstruct, the port 110 such that a path of fluid communication exists from the exterior 140 of the valve assembly 100 to the interior 150 of the valve assembly 100 through the port 110. In the open position, the sliding sleeve 120 can be positioned above the port 110, as shown in FIG. 1, or alternatively, the sliding sleeve 120 can be positioned below the port 110. When the valve assembly 100 is in the closed position, the sliding sleeve 120 is positioned axially-adjacent to, and obstructs, the port 110 such that the path of fluid communication between the exterior 140 and interior 150 of the valve assembly 100 is blocked.

Figure 3:
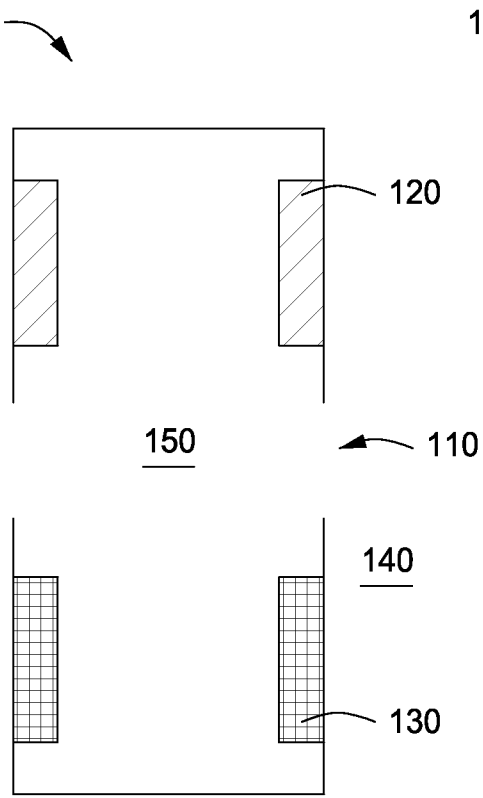
FIG. 3 depicts the sliding sleeve valve assembly of FIG. 1 with a sand screen covering the port, according to one or more embodiments described.

FIG. 3 depicts the valve assembly 100 of FIG. 1 with a sand screen 130 covering the port 110, according to one or more embodiments. The sand screen 130 can be adapted to slide between a non-filtering position (FIGS. 1 and 2) and a filtering position (FIG. 3). In the non-filtering position, the sand screen 130 is axially-offset from the port 110 and can be positioned below the port 110, as shown in FIGS. 1 and 2, or alternatively, the sand screen 130 can be positioned above the port 110. In the filtering position, the sand screen 130 is positioned axially-adjacent to the port 110. When in the filtering position, the sand screen 130 is adapted to filter a fluid, e.g., a hydrocarbon stream, flowing from the exterior 140 of the valve assembly 100 to the interior 150 of the valve assembly 100, thereby reducing the amount of solid particulates flowing through the port 110. In at least one embodiment, the sand screen 130 can be omitted from the valve assembly 100.

Figure 4:
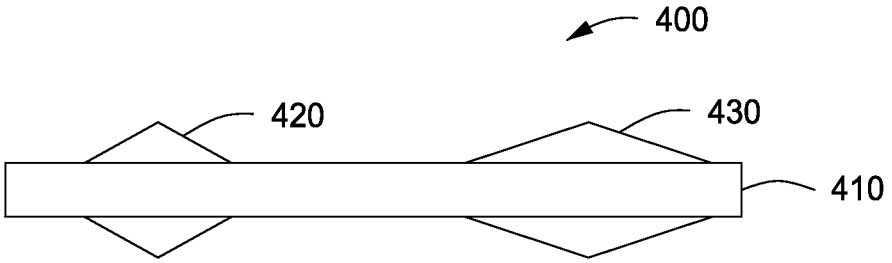
FIG. 4 depicts an illustrative shifting tool, according to one or more embodiments described.

FIG. 4 depicts an illustrative shifting and/or treating tool 400, according to one or more embodiments. The shifting tool 400 can include a shaft or washpipe 410 and a shifting device adapted to actuate the sliding sleeve 120. The shifting device can be electrical, e.g., a transmitter adapted to send/receive a wireless signal, or the shifting device can be mechanical, e.g., an opening collet or key 420 and a closing collet or key 430 coupled to the shaft 410. The shapes of the collets 420, 430 are illustrative and are not meant to be limiting. The opening collet 420 can correspond with an opening profile or groove (not shown) in the valve assembly 100 and/or the sliding sleeve 120. As such, the opening collet 420 can engage the opening profile, and an upward movement of the shifting tool 400 can move the valve assembly 100 into the open position (FIG. 1). The closing collet 430 can correspond with a closing profile or groove (not shown) in the valve assembly 100 and/or the sliding sleeve 120. As such, the closing collet 430 can engage the closing profile, and a downward movement of the shifting tool 400 can move the valve assembly 100 into the closed position (FIG. 2). If the valve assembly 100 is already in the closed position, a downward movement of the shifting tool 400 will not move the sliding sleeve 120, i.e., the valve assembly 100 will remain in the closed position.

In another embodiment, the valve assembly 100 can be opened with an upward movement of the shifting tool 400, and the valve assembly 100 can be closed with an additional upward motion of the shifting tool 400. In another embodiment, the valve assembly 100 can be opened with a downward movement of the shifting tool 400, and the valve assembly 100 can be closed with an additional downward motion of the shifting tool 400. In yet another embodiment, the shifting tool 400 can be rotated, as opposed to an axial movement, to open and close the valve assembly 100.

Although the shifting tool 400 is depicted with collets 420, 430 adapted to actuate, i.e., open and close, the sliding sleeve 120, it can be appreciated that the shifting tool 400 can include any device known in the art capable of actuating the sliding sleeve 120 such as, for example, spring-loaded keys, drag blocks, snap-ring constrained profiles, and the like. Further, the shifting tool 400 can be adapted to generate, detect, and/or transmit signals. The signals can be used to detect or report the position of the shifting tool 400 in the wellbore, to actuate the valve assemblies 100, and/or to deactivate the shifting tool 400, as further described below.

Figure 5:
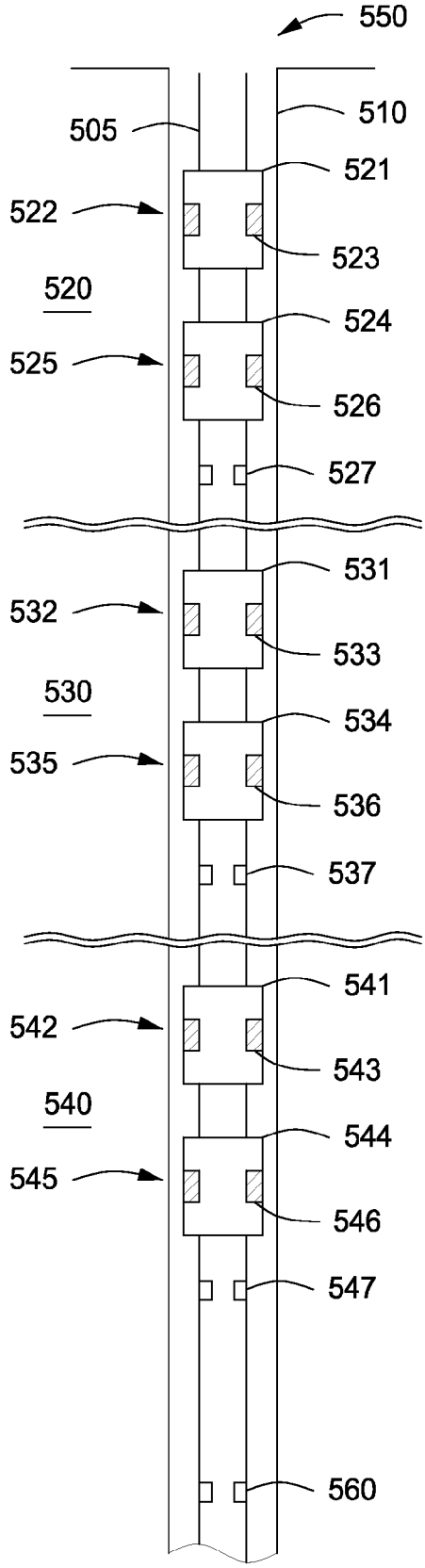
FIG. 5 depicts an illustrative valve arrangement in a wellbore, according to one or more embodiments described.
Figure 6:
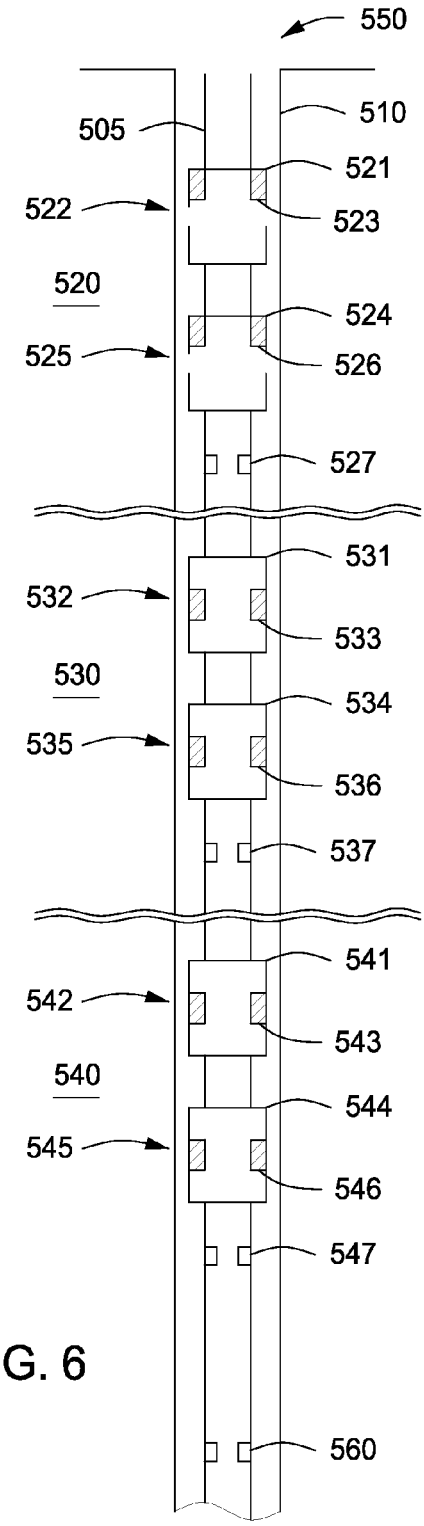
FIG. 6 depicts the valve arrangement of FIG. 5 with the valve assemblies in the first zone in an open position, according to one or more embodiments described.
Figure 7:
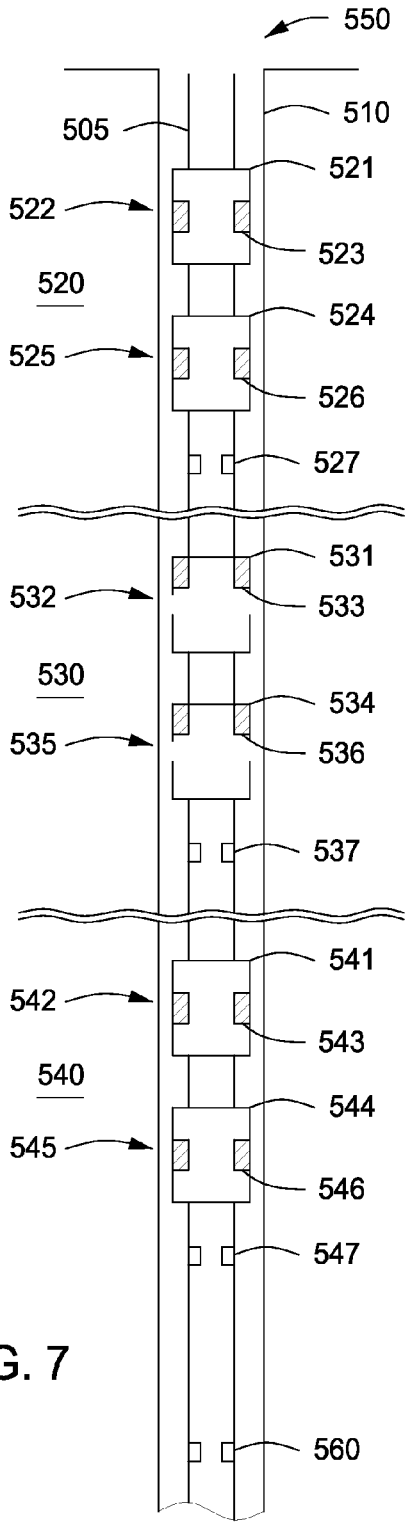
FIG. 7 depicts the valve arrangement of FIG. 5 with the valve assemblies in the second zone in an open position, according to one or more embodiments described.

FIGS. 5-7 depict an illustrative valve arrangement 500 for multi-stage fracturing in a wellbore 510, according to one or more embodiments. As shown, a casing 505 extends through three zones 520, 530, 540 of the wellbore 510. The first zone 520 includes two valve assemblies 521, 524, the second zone 530 includes two valve assemblies 531, 534, and the third zone 540 includes two valve assemblies 541, 544. The valve assemblies 521, 524, 531, 534, 541, 544 can be similar to the valve assembly 100 depicted in FIGS. 1-3, and thus will not be discussed again in detail. As will be appreciated by one of skill in the art, the number of zones 520, 530, 540, and the number of valve assemblies 521, 524, 521, 534, 541, 544 in each zone 520, 530, 540, can vary, for example, depending on the length of the wellbore 510, the volumetric flow rate of fluid therethrough, etc. A position indicator 527, 537, 547 can be located in or between each zone 520, 530, 540. While the position indicators 527, 537, 547 are shown below the valve assemblies 521, 524, 531, 534, 541, 544 in each zone 520, 530, 540, it may be appreciated that additional position indicators 527, 537, 547 can be located anywhere within the zone 520, 530, 540, including between or above the valve assemblies 521, 524, 531, 534, 541, 544.

In operation, the shifting tool 400 can enter the casing 505 proximate the top 550 of the wellbore 510, and begin to move downward. The shifting tool 400 can be conveyed downhole via either drillpipe or on coiled tubing. As used herein, "down" and "downward" include any direction moving away from the top 550 of the wellbore 510, and thus, are not limited to only the vertical direction. "Up" and "upward" include any direction moving toward the top 550 of the wellbore 550, and are also not limited only to the vertical direction. Accordingly, the wellbore 510 is not restricted to a single, vertical wellbore 510, but can be a horizontal, deviated, or multi-lateral wellbore 510 as well.

Upon entry of the shifting tool 400 into the casing 505, the valve assemblies 521, 524, 531, 534, 541, 544 can all be in the closed position, as shown in FIG. 5. As the shifting tool 400 moves downward past the valve assemblies 521, 524 in the first zone 520, the valve assemblies 521, 524 remain in the closed position, as the shifting tool 400 is adapted to move the valve assemblies 521, 524 to the closed position (or keep them in the closed position) when moving downward and move the valve assemblies 521, 524 to the open position when moving upward.

The shifting tool 400 can continue moving downward until the second, closing collet 430 contacts the first position indicator 527. Alternatively, the first, opening collet 420 can contact the first position indicator 527. The first position indicator 527 can include a shoulder adapted to receive the collet 430 and stop downward movement of the shifting tool 400. When the shifting tool 400 stops downward movement, indicating that it has moved past the valve assemblies 521, 524 in the zone 520 to be treated and has reached the first position indicator 527, the location/depth can be noted and recorded at the surface. Other methods for monitoring when the shifting tool 400 contacts the first position indicator 527 can include signal transmission techniques, e.g., acoustic, electromagnetic, and radiofrequency, as known in the art.

Once the location is noted, the shifting tool 400 can move upward past the valve assemblies 521, 524 in the first zone 520. During the upward motion, the opening collet 420 can engage the opening profile in the sliding sleeves 523, 526 and move the valve assemblies 521, 524 to the open position allowing fluid communication through the ports 522, 525, as shown in FIG. 6. At this point, the shifting tool 400 is located above the valve assemblies 521, 524 in the first zone 520, the valve assemblies 521, 524 are in the open position, and the valve assemblies 531, 534, 541, 544 are in the closed position. Proppant-laden fluid can then flow through the shifting tool 400 and the ports 522, 525 to begin the fracturing process. The fracturing only occurs in the first zone 520, as only the first zone 520 has valve assemblies 521, 524 in the open position. After the fracturing process and a suitable washout has taken place, the shifting tool 400 can again move downward through the first zone 520, and the closing collet 430 can engage the closing profile in the sliding sleeves 523, 526 and move the valve assemblies 521, 524 to the closed position, thereby blocking fluid flow through the ports 522, 525.

The shifting tool 400 can then move downward through the second zone 530, which is positioned below the first zone 520. As used herein, "below" refers to a position, e.g., second zone 530, in the wellbore 510 that is farther away from the top 550 than another position, e.g., first zone 520. As the shifting tool 400 moves downward past the valve assemblies 531, 534 in the second zone 530, the valve assemblies 531, 534 remain in the closed position. The shifting tool 400 can continue moving downward until the second, closing collet 430 contacts the second position indicator 537, at which point the location/depth can be noted and recorded at the surface.

Once the location is noted, the shifting tool 400 can move upward past the valve assemblies 531, 534 in the second zone 530. During the upward motion, the opening collet 420 can engage the opening profile in the sliding sleeves 533, 536 and move the valve assemblies 531, 534 to the open position, allowing fluid communication through the ports 532, 535, as shown in FIG. 7. When the shifting tool 400 moves upward to open the valve assemblies 531, 534 in the second zone 530, the shifting tool 400 does not re-enter the first zone 520, and thus, the valve assemblies 521, 524 in the first zone 520 are undisturbed and remain closed. At this point, the shifting tool 400 is located above the valve assemblies 531, 534 in the second zone 530, the valve assemblies 531, 534 are in the open position, and the valve assemblies 521, 524, 541, 544 are in the closed position. Proppant-laden fluid can then flow through the shifting tool 400 and the ports 532, 535 to begin the fracturing process. The fracturing only occurs in the second zone 530, as only the second zone 530 has valve assemblies 531, 534 in the open position. After the fracturing process and a suitable washout has taken place, the shifting tool 400 can again move downward through the second zone 530, and the closing collet 430 can engage the closing profile in the sliding sleeves 533, 536 and move the valve assemblies 531, 534 to the closed position, thereby blocking fluid flow through the ports 532, 535.

The shifting tool 400 can then move downward through the third zone 540, which is positioned below the second zone 530. As the fracturing process in the third zone 540, and subsequent zones, is similar to the process described in relation to the first and second zones 520, 530, the process will not be described again in detail.

Although only described with reference to three zones 520, 530, 540, this multi-stage fracturing process can be applied to any number of zones, and can be accomplished in a single trip of the shifting tool 400, i.e., without pulling the shifting tool 400 back to the surface. For example, the first, upper zone 520 can be fractured first, and the lower zones 530, 540 can be subsequently and sequentially fractured, without removing the shifting tool 400 from the casing 505.

After the shifting tool 400 moves downward past the last, lowermost position indicator 547, and all zones 520, 530, 540 have been fractured, the shifting tool 400 can contact a deactivating device 560 coupled to the casing or liner. The deactivating device 560 can be adapted to remove the ability of the shifting tool 400 to engage and alter the position of the valve assemblies 521, 524, 531, 534, 541, 544. For example, the opening collet 420 can include a sliding sleeve that is originally held in place by a shear ring or pins. At a certain predetermined load, the shear ring/pins may break, thus releasing the sliding sleeve, which will in turn cover and disable the opening collet 420. Alternatively, the fingers of the opening collet 420 will buckle under a predetermined load, thereby deactivating the opening collet 420. Thus, the deactivating device 560 can enable the shifting tool 400 to be pulled upward toward the top 550 of the wellbore 510 without moving the valve assemblies 521, 524, 531, 534, 541, 544 to the open position.

Alternatively, the deactivating device 560 can be a position indicator similar to the position indicators 527, 537, 547 described above. Thus, when the operator at the surface becomes aware that the shifting tool 400 has reached the deactivating device 560, the operator can deactivate the shifting tool 400, for example, via hydraulics, e.g., a ball drop accompanied by pressure in the tubing, electrical signals, e.g., retraction or removal of the collet profiles, magnetic signals, etc. The deactivation device 560 can also include a set-down/pull-up mechanism, which in combination with a built in J-slot, can deactivate the shifting tool 400 after a number of set-down/pull-ups with or without rotation of the service string. Rather than deactivating the shifting tool 400, the sliding sleeves 523, 526, 533, 536, 543, 546 can be deactivated such that the shifting tool 400 is unable to actuate the valve assemblies 521, 524, 531, 534, 541, 544.

After the shifting tool 400 has been deactivated, it can be pulled upward to the surface without disturbing any of the valves 521, 524, 531, 534, 541, 544. Once the shifting tool 400 is removed from the wellbore 510, the sand screens 130 can be moved into the filtering position (FIG. 3). This can be accomplished using a variety of energy forms including, but not limited to, mechanical, e.g., shifting tool, hydraulic, e.g., ball drop or dart replacement, electrical/magnetic, e.g., shifting tool wired for electric current that generates motion downhole, chemical, e.g., chemical reaction downhole including swelling to move the sand screen, etc.

Although the process above is described with reference to fracturing and producing a work-flow, substantially the same process can be used where the wellbore 510 is used for water/gas injection. Additionally, any of the selected valve assemblies 521, 524, 531, 534, 541, 544 can be opened and the formation around them treated, rather than being restricted to a process where all zones 520, 530, 540 need to be treated.

What is claimed is:

1. A method for fracturing multiple zones in a wellbore, comprising:
- opening a first port in a first valve assembly using a shifting tool, wherein opening the first port comprises:
  - engaging a sliding sleeve coupled to the first valve assembly with the shifting tool; and
  - moving the shifting tool upward, thereby moving the sliding sleeve to an open position that is axially-offset from the first port;
- flowing a fluid through the first port to fracture a first zone;
- closing the first port using the shifting tool after the first zone has been fractured, wherein closing the first port comprises:
  - engaging the sliding sleeve with the shifting tool; and
  - moving the shifting tool downward, thereby moving the sliding sleeve to a closed position that is axially-adjacent to the first port;
- opening a second port in a second valve assembly using the shifting tool after the first port has been closed, wherein the second valve assembly is positioned below the first valve assembly;
- flowing the fluid through the second port to fracture a second zone; and
- closing the second port using the shifting tool after the second zone has been fractured.

2. The method of claim 1, wherein the first valve assembly comprises a plurality of first valve assemblies positioned in the first zone, and wherein the second valve assembly comprises a plurality of second valve assemblies positioned in the second zone.

3. The method of claim 2, further comprising contacting a first position indicator with the shifting tool, wherein the first position indicator is positioned below the plurality of first valve assemblies.

4. The method of claim 1, wherein the first and second zones are fractured during a single trip of the shifting tool.

5. A method for fracturing multiple zones in a wellbore, comprising:

opening a first port in a first valve assembly using a shifting tool;

flowing a fluid through the first port to fracture a first zone;

closing the first port using the shifting tool after the first zone has been fractured;

opening a second port in a second valve assembly using the shifting tool after the first port has been closed, wherein the second valve assembly is positioned below the first valve assembly;

flowing the fluid through the second port to fracture a second zone;

closing the second port using the shifting tool after the second zone has been fractured;

contacting a deactivating device with the shifting tool after the first and second zones are fractured, wherein the deactivating device is positioned below the second valve assembly; and disabling one or more collets coupled to the shifting tool with the deactivating device such that the shifting tool is no longer adapted to open the first and second ports.

6. The method of claim 5, further comprising pulling the shifting tool upward and out of the wellbore after the shifting tool has been deactivated.

7. The method of claim 5, wherein opening the first port further comprises:

engaging a sliding sleeve coupled to the first valve assembly with the shifting tool; and moving the shifting tool upward, thereby moving the sliding sleeve to an open position that is axially-offset from the first port.

8. The method of claim 7, wherein closing the first port further comprises:

engaging the sliding sleeve with the shifting tool; and moving the shifting tool downward, thereby moving the sliding sleeve to a closed position that is axially-adjacent to the first port.

9. The method of claim 8, wherein the first valve assembly comprises a plurality of first valve assemblies positioned in the first zone, and further comprising contacting a first position indicator with the shifting tool, wherein the first position indicator is positioned below the plurality of first valve assemblies.

10. A method for fracturing multiple zones in a wellbore, comprising:

moving a shifting tool downward through a first zone in the wellbore until the shifting tool contacts a first position indicator;

moving the shifting tool upward through the first zone, thereby opening a first valve assembly disposed therein;

fracturing the first zone by flowing a fluid through a first port in the first valve assembly;

moving the shifting tool downward through the first zone, thereby closing the first valve assembly;

moving the shifting tool downward through a second zone until the shifting tool contacts a second position indicator, wherein the second zone is positioned below the first zone;

moving the shifting tool upward through the second zone, thereby opening a second valve assembly disposed therein;

fracturing the second zone by flowing the fluid through a second port in the second valve assembly; and moving the shifting tool downward through the second zone, thereby closing the second valve assembly.

11. The method of claim 10, wherein the first valve assembly comprises two or more first valve assemblies disposed in the first zone, and wherein the second valve assembly comprises two or more second valve assemblies disposed in the second zone.

12. The method of claim 10, further comprising:

moving the shifting tool downward through a third zone until the shifting tool contacts a third position indicator, wherein the third zone is positioned below the second zone;

moving the shifting tool upward through the third zone, thereby opening a third valve assembly disposed therein;

fracturing the third zone by flowing the fluid through a third port in the third valve assembly; and moving the shifting tool downward through the third zone, thereby closing the third valve assembly.

13. The method of claim 10, wherein fracturing the first and second zones is completed in a single trip of the shifting tool.

14. The method of claim 10, wherein opening the first valve assembly further comprises:

engaging a sliding sleeve coupled to the first valve assembly with the shifting tool; and moving the shifting tool upward, thereby moving the sliding sleeve to an open position that is axially-offset from the first port.

15. The method of claim 10, further comprising deactivating the shifting tool with a deactivating device positioned below the second position indicator and the second valve assembly.

16. A system for fracturing multiple zones in a wellbore, comprising:

a first valve assembly comprising a first sliding sleeve movable between open and closed positions;

a first position indicator positioned below the first valve assembly;

a second valve assembly positioned below the first position indicator and including a second sliding sleeve movable between open and closed positions;

a second position indicator positioned below the second valve assembly; and a shifting tool adapted to move the first sliding sleeve to the open position to allow fracturing to occur in a first zone and then move the first sliding sleeve to the closed position, and subsequently move the second sliding sleeve to the open position to allow fracturing to occur in a second zone and then move the second sliding sleeve to the closed position.

17. The system of claim 16, wherein the first valve assembly comprises a plurality of first valve assemblies, and wherein the first position indicator is positioned below each of the first valve assemblies.

18. The system of claim 16, wherein the first sliding sleeve is positioned axially-offset from a first port in the first valve assembly in the open position, and wherein the first sliding sleeve is positioned axially-adjacent to the first port in the closed position.

19. The system of claim 18, wherein the shifting tool comprises one or more collets coupled thereto and adapted to engage the first sliding sleeve.

20. The system of claim 19, further comprising a deactivating device positioned below a lowermost position indicator in a lowermost zone, wherein the deactivating device comprises a third sliding sleeve secured about the shifting tool with a shear pin, and wherein the shear pin is adapted to break at a predetermined load such that the third sliding sleeve covers the one or more collets, thereby preventing the one or more collets from engaging the first sliding sleeve.

* * * * *